US010024017B2

(12) United States Patent
Nottingham et al.

(10) Patent No.: US 10,024,017 B2
(45) Date of Patent: Jul. 17, 2018

(54) CELLULAR SHEET PILE RETAINING SYSTEMS WITH UNCONNECTED TAIL WALLS, AND ASSOCIATED METHODS OF USE

(75) Inventors: William D. Nottingham, Carter, MT (US); Michael Hartley, Mercer Island, WA (US); William F. Gunderson, Seattle, WA (US)

(73) Assignee: PND Engineers, Inc., Anchorage, AK (US)

( * ) Notice: Subject to any disclaimer, the term of this patent is extended or adjusted under 35 U.S.C. 154(b) by 0 days.

(21) Appl. No.: 12/879,997

(22) Filed: Sep. 10, 2010

(65) Prior Publication Data

US 2011/0064527 A1 Mar. 17, 2011

Related U.S. Application Data

(60) Provisional application No. 61/241,838, filed on Sep. 11, 2009.

(51) Int. Cl.

| | |
|---|---|
| ***E02D 29/02*** | (2006.01) |
| ***E02D 5/04*** | (2006.01) |
| ***E02D 5/10*** | (2006.01) |
| ***E02D 5/02*** | (2006.01) |

(52) U.S. Cl.
CPC ..... *E02D 5/02* (2013.01)

(58) Field of Classification Search
CPC ..... E02D 29/02; E02D 29/0266; E02D 5/02; E02D 5/04; E02D 5/10; E02D 27/30; E02D 19/04
USPC ..... 405/284, 285, 274, 276
See application file for complete search history.

(56) References Cited

U.S. PATENT DOCUMENTS

| | | | | |
|---|---|---|---|---|
| 370,108 | A * | 9/1887 | Wakefield | E02D 5/02 405/274 |
| 400,155 | A * | 3/1889 | Williscraft | E02D 5/02 405/274 |
| 717,135 | A * | 12/1902 | Taylor | E02D 5/04 405/276 |
| 912,661 | A | 2/1909 | Fiero | |
| 923,110 | A | 5/1909 | Conkling | |

(Continued)

FOREIGN PATENT DOCUMENTS

| | | | |
|---|---|---|---|
| EP | 1813727 | A2 * | 8/2007 |
| JP | 55136328 | A * | 10/1980 |

(Continued)

*Primary Examiner* — Benjamin F Fiorello
*Assistant Examiner* — Edwin J Toledo-Duran
(74) *Attorney, Agent, or Firm* — Perkins Coie LLP

(57) ABSTRACT

Embodiments of the disclosure are directed to cellular sheet pile retaining wall systems with unconnected tail walls, and associated methods of use and manufacture. In one embodiment, a retaining system includes a face wall having a plurality of interconnected face wall sheet piles. The individual face wall sheet piles have a first length and extend a first depth into soil, and the face wall sheet piles form an exterior surface facing an exterior environment. The system also includes a tail wall including a plurality of interconnected tail wall sheet piles extending from the face wall away from the exterior environment. The individual tail wall sheet piles have a second length greater than the first length, and the individual tail sheet wall piles extend a second depth into the soil that is greater than the first depth.

19 Claims, 7 Drawing Sheets

(56) References Cited

U.S. PATENT DOCUMENTS 968,450 A 8/1910 Conkling et al.
969,343 A 9/1910 Conkling
975,665 A * 11/1910 Wemlinger ..... E02D 29/025 405/284
1,005,514 A 10/1911 Conkling
1,012,124 A 12/1911 Conkling
1,032,109 A 7/1912 Buckingham
1,071,985 A 9/1913 Conkling
1,277,847 A * 9/1918 Cahn ..... E02D 19/04 405/14
1,341,949 A 6/1920 Troye
1,437,044 A 11/1922 Cushing
1,806,967 A 5/1931 Dougherty et al.
1,834,744 A 12/1931 Schroeder
1,896,259 A 2/1933 Thackray
1,907,135 A * 5/1933 Wemlinger ..... E02B 3/066 405/285
1,942,163 A * 1/1934 Di Zoppola ..... E02B 3/04 405/279
1,943,800 A * 1/1934 Morrison ..... E02D 5/20 405/285
1,951,292 A 3/1934 Cahill
1,951,293 A 3/1934 Cahill
2,004,188 A 6/1935 Borberg
2,018,446 A * 10/1935 Jensen ..... 405/280
2,057,947 A 10/1936 Hausler
2,074,906 A 3/1937 Hausler
2,128,012 A * 8/1938 O'Rourke ..... E02B 3/04 405/21
2,128,428 A 8/1938 Murray, Jr.
2,184,974 A * 12/1939 Henderson ..... E02D 29/0266 405/285
2,909,901 A 10/1959 Suderow
2,968,931 A * 1/1961 McGrath ..... E02D 13/02 29/281.6
3,059,436 A 10/1962 Hermann
3,302,412 A 2/1967 Hunsucker
3,613,382 A * 10/1971 Dickinson ..... E02B 3/066 405/285
3,751,930 A 8/1973 Mott et al.
3,754,403 A 8/1973 Mott et al.
3,797,258 A 3/1974 Dubuisson et al.
3,802,205 A * 4/1974 Dickinson ..... E02B 3/066 405/285
3,822,557 A 7/1974 Frederick
3,959,938 A * 6/1976 Zachariassen ..... E02D 29/0266 52/293.1
3,971,224 A * 7/1976 Elkuch ..... E02D 5/04 405/285
3,993,396 A 11/1976 Eigenbrode et al.
4,050,254 A * 9/1977 Meheen ..... E02D 29/0266 405/285
4,369,004 A * 1/1983 Weatherby ..... E02D 29/02 405/262
4,419,030 A * 12/1983 Burkemper ..... E02D 5/04 405/232
4,479,742 A 10/1984 Bruce
4,486,125 A 12/1984 Reusswig
4,511,288 A 4/1985 Wetmore
4,579,481 A 4/1986 Gerwick et al.
4,596,495 A 6/1986 Scharnell et al.
4,618,286 A 10/1986 Michel et al.
4,647,257 A 3/1987 Robishaw
4,685,838 A 8/1987 Curt
4,790,690 A * 12/1988 Vidal ..... E02D 29/0225 405/262
4,890,959 A 1/1990 Robishaw et al.
5,213,447 A 5/1993 Srock
5,292,207 A 3/1994 Scott
5,437,520 A * 8/1995 Cherry ..... E02D 5/14 405/276
5,505,563 A * 4/1996 Curt ..... E02D 5/20 405/262
5,520,487 A 5/1996 Decker
6,135,675 A * 10/2000 Moreau ..... E02B 3/066 405/284
6,234,720 B1 * 5/2001 Queen et al. ..... 405/232
6,371,699 B1 * 4/2002 Weinreb ..... E02D 29/0233 405/262
6,443,659 B1 9/2002 Patout
6,499,914 B1 12/2002 Patout
6,715,964 B2 * 4/2004 Nottingham ..... 405/278
7,018,141 B2 3/2006 Nottingham
7,033,118 B2 * 4/2006 Hilfiker ..... E02D 29/0208 405/262
7,086,811 B2 * 8/2006 Lewis ..... E02D 29/0216 405/262
7,107,225 B1 9/2006 McClung, III
7,488,140 B2 2/2009 Nottingham
7,958,835 B2 6/2011 Srinivasan
2002/0054791 A1 * 5/2002 Nottingham ..... E02D 5/02 405/285
2004/0206516 A1 * 10/2004 Benedict ..... E02B 3/04 172/1
2007/0163186 A1 7/2007 Baugh et al.
2008/0286053 A1 11/2008 Baugh et al.
2009/0232607 A1 * 9/2009 Nottingham ..... E02D 5/02 405/279
2010/0143044 A1 6/2010 Kadaster et al.
2010/0290843 A1 * 11/2010 Irvine ..... E02D 5/02 405/274
2011/0064527 A1 * 3/2011 Nottingham ..... E02D 5/02 405/274

FOREIGN PATENT DOCUMENTS

JP 60062326 A * 4/1985
JP 03093917 A * 4/1991

* cited by examiner

CELLULAR SHEET PILE RETAINING SYSTEMS WITH UNCONNECTED TAIL WALLS, AND ASSOCIATED METHODS OF USE

CROSS-REFERENCE TO RELATED APPLICATIONS

The present application claims priority to U.S. Provisional Patent Application No. 61/241,838, titled "OPEN CELL SHEET PILE RETAINING WALLS AND ASSOCIATED METHODS OF USE AND MANUFACTURE", filed Sep. 11, 2009, which is incorporated herein by reference in its entirety.

TECHNICAL FIELD

The following disclosure relates generally to soil retaining systems, and more specifically to cellular sheet pile retaining systems with unconnected sheet pile tail walls, and associated structures and methods.

BACKGROUND

Marine related bulkheads constructed along the coast of Alaska experience some of the most severe environmental conditions known, including high waves and wave scour, earthquakes, ice, high tide variations, high phreatic water levels, weak soils, exposed or near-surface bedrock, heavy live loads, and difficult construction conditions. The need for low-cost, high load capacity docks and structures that allow field adaptation to changing field conditions has resulted in a development of various sheet pile retaining structures.

Flat steel sheet piles have been used in simple structures featuring primarily tension or membrane action. Foundation designs of cellular cofferdams are discussed in detail in the text by Joseph E. Bowles, Foundation Analysis and Design (1977) herein incorporated in its entirety by reference. One configuration, a closed cell flat sheet pile structure, had been successfully used for many years for a wide variety of structures including cofferdams and docks. The most common use for flat sheet piles has been in closed cellular bulkhead structures of various geometrical arrangements. Another configuration includes a diaphragm closed cell structure. By closing the cell structure, the entire structure acts as a deadman anchor in the retaining system to provide additional retaining support. However, positive structural aspects of these closed cell structures are often offset by high construction costs. Several factors have contributed to higher costs, including, for example: multiple templates required for construction alignment; close tolerances; difficulty with driving through obstacles and holding tolerance; backfilling operations using buckets or conveyors; and difficulty compacting the backfill.

Another sheet pile retaining form has been the tied back wall masterpile system with flat sheet piles acting as a curved tension face. Tieback anchors with deadmen are connected to the curved tension face to provide lateral retaining strength. This configuration allows a higher load to be retained with fewer sheet piles used as the anchors and the sheets work in concert to retain the earth load. However, tied back sheet pile walls often require deep toe embedment for lateral strength, and if that toe embedment is removed for any number of reasons, wall failure will result. This configuration further requires excavation for placement of the soil anchors, or an expensive and time consuming drilling operation to install the soil anchors, at the appropriate depth to integrate them with the sheet pile wall. Additionally, tied back walls are at risk in environments where waves overtop the wall and result in scour. Scour undermines the base of the bulkhead and the needed toe support resulting in failure of the bulkhead. The tied back walls are subject to failure during seismic events at the tied back connection to the wall and failure due to corrosion either at the tied back connection to the wall or the wall itself where corrosion of the exposed wall at the air/water interface occurs.

DETAILED DESCRIPTION

Several embodiments of the disclosure are described below with reference to soil retaining systems, and more particularly, with reference to cellular sheet pile retaining wall systems with unconnected tail walls, and associated methods of use. In one embodiment, for example, a retaining system includes a face wall having a plurality of interconnected face wall sheet piles. The individual face wall sheet piles have a first length and extend a first depth into soil. The face wall sheet piles form an exterior surface facing an exterior environment, such as water, shoreline, beach, river, valley, etc. The system also includes a first tail wall including a plurality of interconnected first tail wall sheet piles extending from the face wall away from the exterior environment. The individual first tail wall sheet piles anchor the face wall and have a second length greater than the first length. Moreover, the individual first tail wall sheet piles extend a second depth into the soil that is greater than the first depth. The system further includes a second tail wall spaced apart from and unconnected to the first tail wall. The second tail wall has a plurality of interconnected second tail wall sheet piles extending from the face wall away from the exterior environment to further anchor the face wall. The individual second tail wall sheet piles have a third length approximately equal to or greater than the second length. Moreover, individual second tail wall sheet piles extend a third depth into the soil, the third depth being equal to or greater than the second depth.

Specific details are identified in the following description with reference to FIGS. 1A-6 to provide a thorough understanding of various embodiments of the disclosure. Other details describing well-known structures or processes often associated with sheet pile retailing walls, however, are not described below to avoid unnecessarily obscuring the description of the various embodiments of the disclosure. Moreover, although the following disclosure sets forth several embodiments of different aspects of the invention, other embodiments can have different configurations and/or different components and structures than those described in this section. In addition, further embodiments of the disclosure may be practiced without several of the details described below, while still other embodiments of the disclosure may be practiced with additional details and/or features.

Many of the details, dimensions, angles and/or other portions shown in the Figures are merely illustrative of particular embodiments of the disclosure. Accordingly, other embodiments can have other details, dimensions, angles and/or portions without departing from the spirit or scope of the present disclosure. In addition, further embodiments of the disclosure may be practiced without several of the details described below, while still other embodiments of the disclosure may be practiced with additional details and/or features.

Figure 1A:
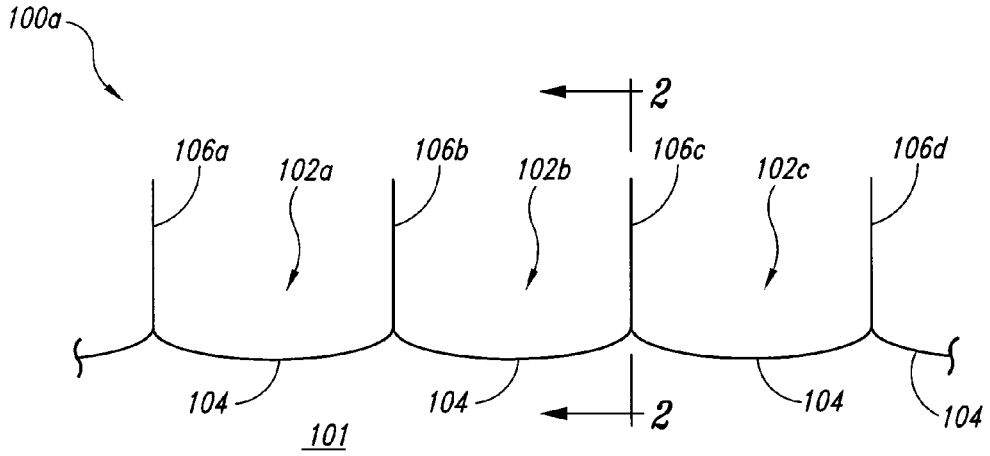
FIGS. 1A-1E are a series of plan schematic views of soil retaining systems configured in accordance with an embodiment of the disclosure.
Figure 1B:
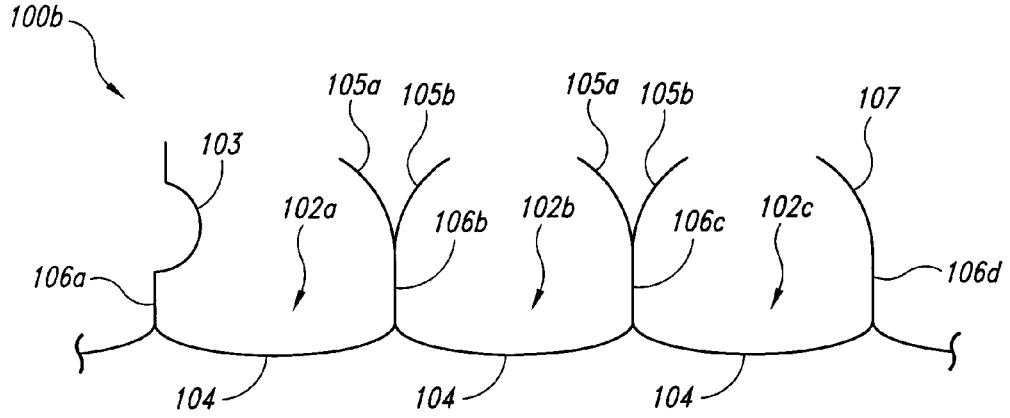

FIG. 1A is a plan schematic view of a cellular sheet pile retaining system 100*a* ("system 100*a*") configured in accordance with an embodiment of the disclosure. The illustrated system 100*a* includes multiple cell sheet pile structures 102 (identified individually as a first through third cell structures 102*a*-102*c*). Each cell structure 102 is formed from multiple interconnected sheet piles. More specifically, each cell structure 102 includes an exposed sheet face wall 104 extending between corresponding unconnected sheet tail walls 106 (identified individually as first through fourth tail walls 106*a*-106*d*). Adjacent cell structures 102 accordingly share a single tail wall 106. When viewed in plan as shown in FIG. 1A, the system 100*a* includes multiple interconnected U-shaped cell structures 102. The face walls 104 and tail walls 106 of each cell structure 102 are at least partially embedded in soil, and the tail walls 106 act as anchors for the corresponding face walls 104. The face walls 104 are exposed to an exterior environment 101, such as water. In certain embodiments, the face walls 104 and tail walls 106 can be interconnected and/or include integral soil anchors as described in U.S. Pat. No. 6,715,964 to William Dennis Nottingham, entitled "Earth Retaining System Such as a Sheet Pile Wall with Integral Soil Anchors," filed Jul. 30, 2001; U.S. Pat. No. 7,018,141 to William Dennis Nottingham, entitled "Earth Retaining System Such as a Sheet Pile Wall with Integral Soil Anchors," filed Mar. 15, 2004; and U.S. Pat. No. 7,488,140 to William Dennis Nottingham, entitled "Earth Retaining System Such as a Sheet Pile Wall with Integral Soil Anchors," filed Feb. 1, 2006, each of which is incorporated herein by reference in its entirety.

As described below in detail with reference to FIGS. 2-6, portions of the individual tail walls 106, such as individual piles, can be embedded in the soil (e.g., in a direction into the plane of FIG. 1A) at a greater or lesser depth than that of the corresponding face walls 104. Moreover, portions of the individual tail walls 106, such as individual piles, can have a greater or lesser length (e.g., in the direction extending into the soil) than the corresponding face walls 104.

FIGS. 1B-1E are a series of plan schematic views of cellular sheet pile retaining systems with unconnected tail walls configured in accordance with further embodiments of the disclosure. The systems illustrated in FIGS. 1B-1E include several features that are generally similar in structure and function to the corresponding features of the system 100*a* shown in FIG. 1A. For example, the system 100*b* illustrated in FIG. 1B includes cell structures 102 (identified individually as first through third cell structures 102*a*-102*c*) having face walls 104 extending between corresponding unconnected tail walls 106 (identified individually as first through fourth tail walls 106*a*-106*d*). The embodiments shown in FIGS. 1B-1E illustrate several possible configurations of the tail walls. In the embodiment illustrated in FIG. 1B, for example, several of the tail walls 106 have curved portions to account for various obstructions or site conditions. More specifically, for example, a mid-segment of the first tail wall 106*a* has a curved portion 103. Moreover, the second and third tail walls 106*b*, 106*c* each includes a bifurcated end including a first end portion 105*a* curved away from or otherwise diverging from a second end portion 105*b*. In addition the fourth tail wall 106*d* has a single curved or non-linear end portion 107. In other embodiments, the tail walls 106 can include other portions having other shapes or extending in other suitable directions to accommodate site conditions. In still further embodiments, the tail wall 106*d* can be staggered up or down.

Figure 1C:
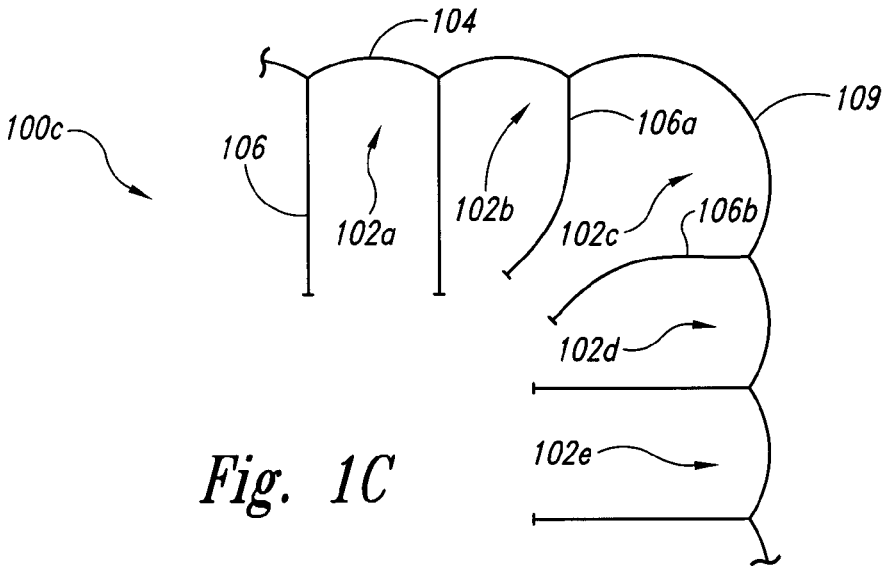

Referring next to FIG. 1C, the system 100*c* illustrated in FIG. 1C includes cell structures 102 (identified individually as first through fifth cell structures 102*a*-102*e*) having face walls 104 extending between corresponding tail walls 106. In the embodiment illustrated in FIG. 1C, however, the third cell structure 102*c* is curved to span or otherwise form a corner in the system 100*c*. As such, the third cell structure 102*c* includes corresponding first and second tail walls 106*a* that are curved away from one another so as not to intersect one another at an interior portion of the third cell structure 102*c*. In other embodiments, however, the tail walls 106 of a corresponding corner cell structure 102 can be shortened so as to not intersect one another. In still further embodiments, the tails walls 106 of a corner cell structure can intersect one another or any other corresponding tail wall.

Figure 1D:
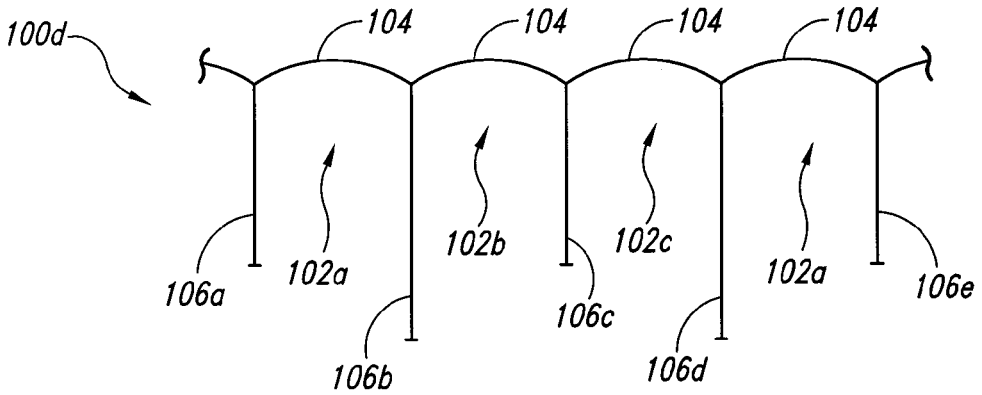

In FIG. 1D, the illustrated system 100*d* also includes multiple cell structures 102 (identified individually as first through fourth cell structures 102*a*-102*d*) having face walls 104 extending between corresponding tail walls 106 (identified individually as first through fifth tail walls 106*a*-106*e*). In the embodiment illustrated in FIG. 1D, however, the tail walls 106 extend varying lengths away from the corresponding face walls 104. The tail walls 106 of varying length can accordingly account for various site conditions, seismic conditions, etc.

Figure 1E:
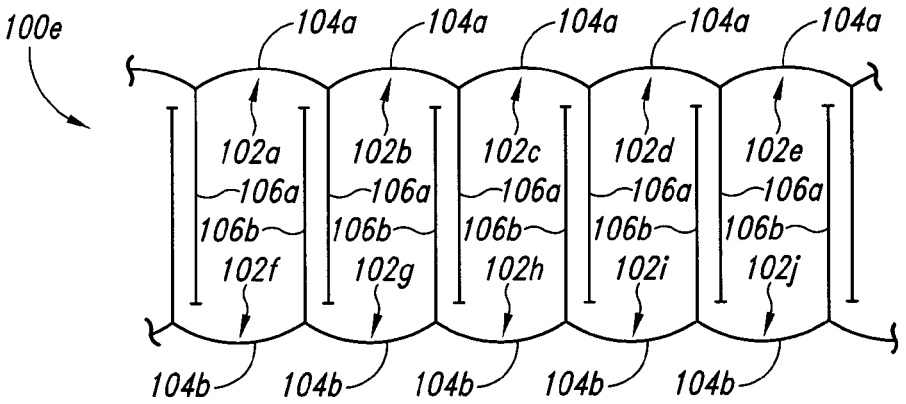

In FIG. 1E, the illustrated system 100*e* also includes multiple back-to-back or opposing cell structures 102 (identified individually as first through fifth cell structures 102*a*-102*e* opposite corresponding sixth through tenth cell structures 102*f*-102*j*). First tail walls 106*a* extending from the corresponding first through fifth cell structures 102*a*-102*e* and are positioned adjacent to second tail walls 106*b* extending from the corresponding sixth through tenth cell structures 102*f*-102*j*. The back-to-back system 100*e* shown in FIG. 1E can accordingly provide an economical alternative to closed cell systems, which can be more difficult and expensive to construct. As one of ordinary skill in the art will appreciate, embodiments of the present disclosure are not limited to the configurations shown in FIGS. 1A-1E.

Figure 2:
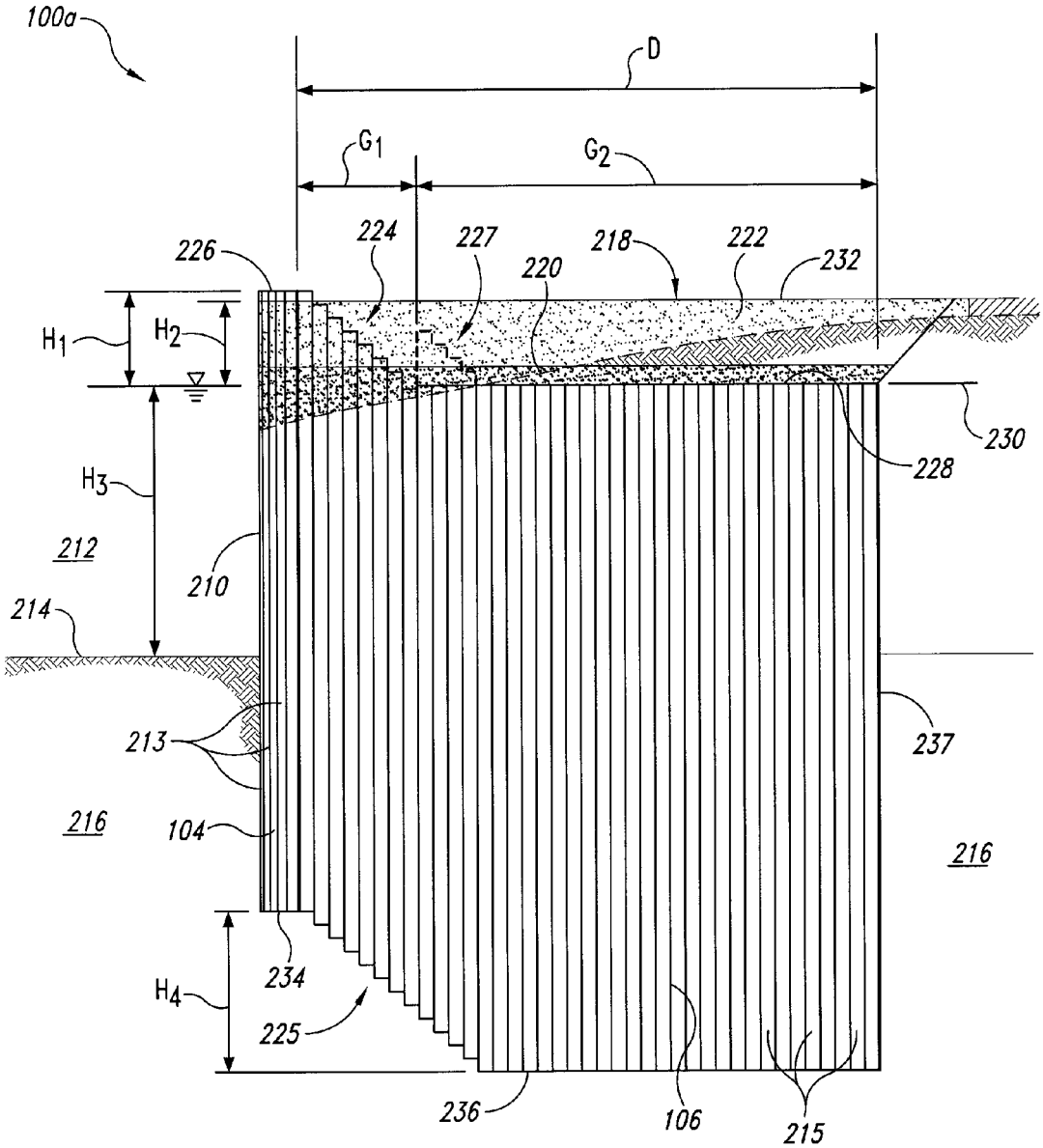
FIG. 2 is a cross-sectional side view taken substantially along lines 2-2 of FIG. 1A.

FIG. 2 is a side cross-sectional view taken substantially along lines 2-2 of FIG. 1A illustrating several additional features of the system 100*a*. For example, and as shown in the illustrated embodiment, the face wall 104 includes a series of interconnected face wall sheets or piles 213 that are partially embedded in soil 216. The face wall piles 213 form an exposed surface 210 of the face wall 104 that faces an exterior environment 212 (e.g., water, shoreline, beach, river, valley, etc.). In certain embodiments, the exterior environment 212 can have a lower exterior level or surface 214 (e.g., ground, sea floor, river bed, valley floor, etc.). The tail wall 106 includes a series of interconnected tail wall sheets or piles 215 extending away from the face wall 104. The individual tail wall piles 215 are at least partially embedded in the soil 216 and at least partially covered with backfill material 218. More specifically, the backfill material 218 can include at least a first backfill 220 (e.g., granular fill) covered by a second backfill 222 (e.g., surfacing and/or grading fill). In certain embodiments, utility or fuel lines and the like can be buried in the second backfill 222 and/or the first backfill 220. In this manner, these lines can be protected from freezing and also be readily accessible for repair, leakage clean-up, replacement, etc.

The face wall piles 213 and the tail wall piles 215 can be made from various materials including, for example, steel, aluminum, vinyl, plastic, wood, concrete, fiberglass, metallic and non-metallic alloys, and any other suitable materials. In certain embodiments, the tail wall 106 can include an anchor 237 spaced apart from the face wall 104. The anchor can be configured to increase the pull-out resistance of the face wall 104. For example, the anchor 237 can be a tie-back anchor or dead weight that is operably coupled to the tail wall 106. In certain embodiments, the anchor 237 can be integrally formed with the tail wall 106. For example, the anchor 237 can be integrally formed with the final tail wall pile 215 in the tail wall 106. In other embodiments, however, the anchor 237 can be attached to the tail wall 106 (e.g., by welding, via a cable or rod, etc.).

According to one feature of the illustrated embodiment, the tail wall 106 is embedded in the soil 216 at a depth that is deeper than that of the face wall 104. Moreover, at least some of the tail wall piles 215 are longer than the face wall piles 213 (i.e., in the axial direction of these piles). More specifically, the tail wall 106 includes a first group $G_1$ of tail wall piles 215 and a second group of tail wall piles $G_2$. In the illustrated embodiment, the first group $G_1$ includes 8 tail wall piles 215, and the second group $G_2$ includes 31 tail wall piles 215. In other embodiments, however, the first group $G_1$ and the second group $G_2$ can include greater than or less than 8 and 31 tail wall piles 215, respectively. The face wall piles 213 and the tail wall piles 215 of the first group $G_1$ have a first length, and the tail wall piles 215 of the second group $G_2$ have a second length that is greater than the first length. In one embodiment, for example, the first length can be approximately 69 feet and the second length can be approximately 77 feet. In other embodiments, however, the first and second lengths can be greater than or less than 69 feet and 77 feet, respectively, depending, for example, on the conditions and environment where the system 100*a* is constructed.

As also shown in the illustrated embodiment, the first group $G_1$ of tail wall piles 215 forms an upper staggered or stepped portion 224 of the tail wall 106 extending from a first upper surface 226 of the face wall 104 to a second upper surface 228 of the tail wall 106. The tail wall 106 also includes a lower staggered or stepped portion 225 extending from a first lower surface 234 of the face wall 104 to a second lower surface 236 of the tail wall 106. In one embodiment, for example, the individual tail wall piles 215 in the first group $G_1$ can be staggered from each other by a height of approximately 6-18 inches, or approximately 12 inches. In other embodiments, however, these piles can be staggered by a height less than 6 inches or greater than 18 inches.

Several more features of the tail wall 106 are described with reference to a tail wall elevation 230 at the second upper surface 228 of the tail wall 106. For example, the first upper surface 226 is at a first height $H_1$ from the tail wall elevation 230, and an exterior surface 232 of the backfill 218 is at a second height $H_2$ from the tail wall elevation 230. Moreover, the lower exterior level 214 of the exterior environment 212 is at a third height $H_3$ below the tail wall elevation 230. In addition, the first bottom surface 234 of the face wall 104 is at a fourth height $H_4$ from a second bottom surface 236 of the tail wall 106. In certain embodiments, the first height $H_1$ can be approximately 10 feet, the second height $H_2$ can be approximately 9 feet, the third height $H_3$ can be approximately 30 feet, and the fourth height $H_4$ can be approximately 18 feet. In other embodiments, however, these heights can be greater than or less than these values to allow staggering tail walls both up and down.

As also shown in FIG. 2, at the second upper surface 228 of the tail wall 106 following the transition from the first group $G_1$ to the second group $G_2$ of tail wall piles 215, upper portions 227 of several of the initial tail wall piles 215 of the second group $G_2$ can be cut-off or otherwise removed at the elevation of the second upper surface 228 of, as shown by broken lines. The upper portions 227 can be removed because the tail wall piles 215 may be available only in certain predetermined lengths. Moreover, removing these portions of the tail wall piles 215 allows the second upper surface 228 to be generally flat while the lowered staggered portion 225 of the tail wall 106 continues to extend deeper into the soil 216. In addition, the first staggered portion 224 of the tail wall 106 extends away from the face wall 104 by a shorter distance than that of the second staggered portion 224 of the tail wall 106.

The staggered portion of the tail wall 106 allows the second group $G_2$ of tail wall piles 215 to be embedded in the soil 216 at a greater depth than the face wall 104. Moreover, the tail wall piles 215 of the second group $G_2$, which are longer in the longitudinal direction than the face wall piles 213, contribute to the extended depth of the second bottom surface 236 of the tail wall 106 with reference to the first bottom surface 234 of the face wall 104. In certain embodiments, for example, the second bottom surface 236 of the tail wall 106 can be approximately 18 feet below the first bottom surface 234 of the face wall 104. Accordingly, the second bottom surface 234 of the tail wall 106 can be approximately 78 feet from the first upper surface 226 of the face wall 104. In other embodiments, however, these distances can be greater or less than these values.

These features of the tail wall 106 (e.g., that the tail wall 106 that is embedded deeper than the face wall 104, and the longer tail wall piles 215 of the second group $G_2$) provide several advantages over conventional retaining walls. For example, the illustrated tail wall 106 provides an increased pull-out resistance of the face wall 104, which accordingly yields a higher ultimate tension. This configuration also improves the stability of the system 100*a* while also advantageously allowing the tail wall 106 to have a shorter distance D extending away from the face wall 104 compared to conventional retaining wall systems. For example, in areas with limited property rights or in soft soils, the deeper tail wall 106 with longer tail wall piles 215 can reduce the distance D of the tail wall 106 extending away from the face wall 104. These deeper tail wall piles 215 can also anchor the tail wall 106 into denser or stiffer soil below the soil failure zone as described below with reference to FIG. 5. The illustrated tail wall 106 can also reduce the cost of the system 100*a* because fewer tail wall 106 materials are required due to the reduced distance D of the tail wall 106.

Figure 3:
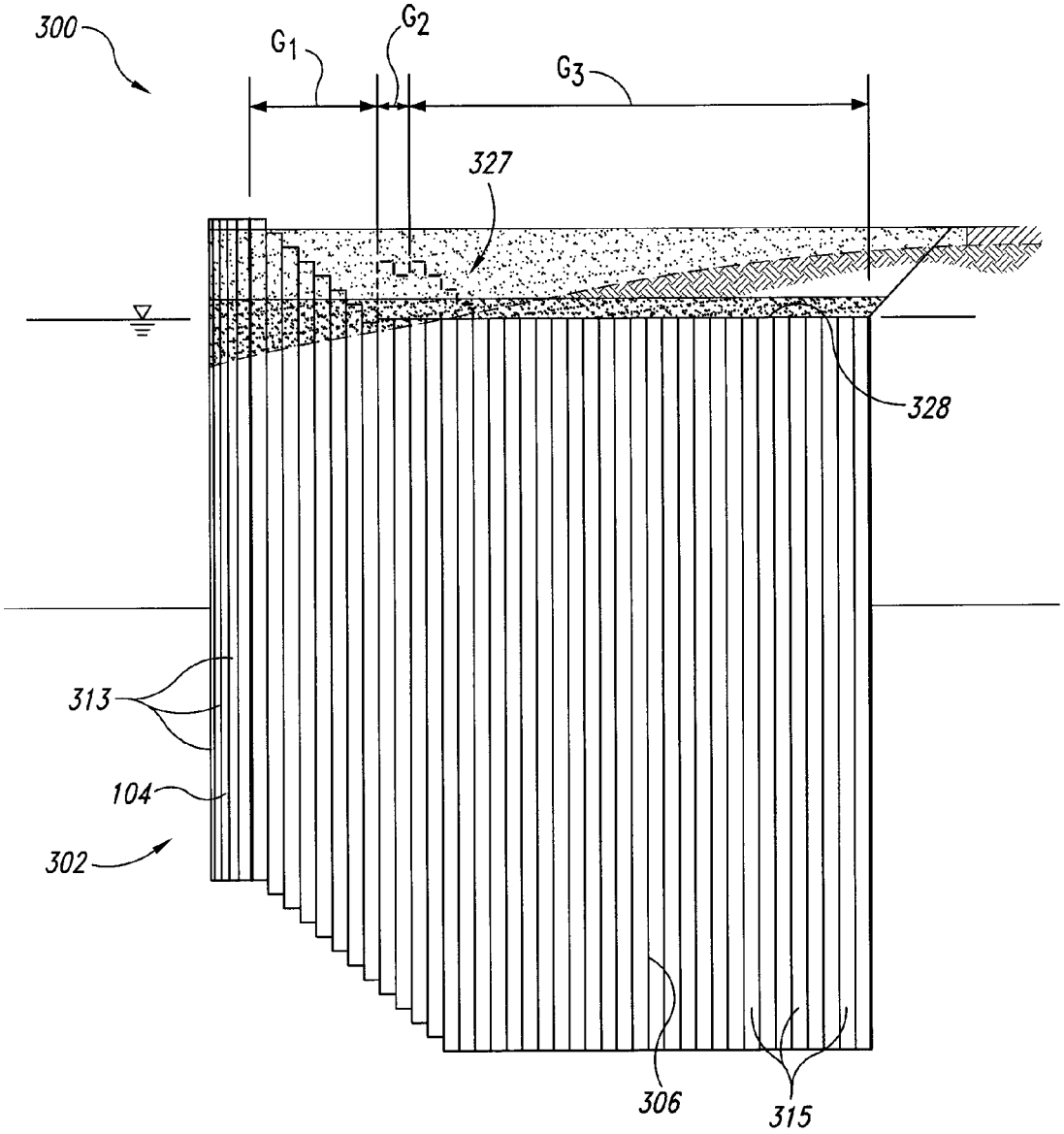
FIGS. 3-6 are a series of cross-sectional side views of systems configured in accordance with further embodiments of the disclosure.

FIG. 3 is a cross-sectional side view of a system 300 configured in accordance with another embodiment of the disclosure. The illustrated system 300 includes several features that are generally similar in structure and function to the corresponding features of the systems described above with reference to FIGS. 1A-2. For example, the system 300 includes a cell structure 302 with multiple tail wall sheet piles 315 forming a tail wall 306, and multiple face wall piles 313 forming a face wall 304. In the illustrated embodiment, however, the tail wall 306 includes a first group $G_1$, a second group $G_2$, and a third group $G_3$ of the tail wall piles 315. As shown in FIG. 3, the first group $G_1$ includes 8 tail wall piles 315, the second group $G_2$ includes 2 tail wall piles 315, and the third group $G_3$ includes 27 tail wall piles 315. In other embodiments, however, the first group $G_1$, the second group $G_2$, and the third group $G_3$ can include greater than or less than 8, 2, and 27 tail wall piles 315, respectively. Moreover, in certain embodiments the face wall piles 313 and tail wall piles 315 in the first group $G_1$ have a first length, the tail wall piles 315 in the second group $G_2$ have a second length, and the tail wall piles 315 in the third group $G_3$ have a third length. In one embodiment, the first length can be approximately 69 feet, the second length can be approximately 77 feet, and the third length can be approximately 80 feet. In other embodiments, however, the first, second, and third lengths can be greater than or less than these values.

As also shown in the embodiment illustrated in FIG. 3, at an upper surface 328 of the tail wall 306 following the transition from the first group $G_1$ to the second group $G_2$, and from the second group $G_2$ to the third group $G_3$ of the tail wall piles 315, upper portions 327 of several of the initial tail wall piles 315 of the second group $G_2$ and third group $G_3$ can be cut-off or otherwise removed at the elevation of the second upper surface 328 of, as shown by broken lines similar to the system 100*a* described above with reference to FIG. 2.

Figure 4:
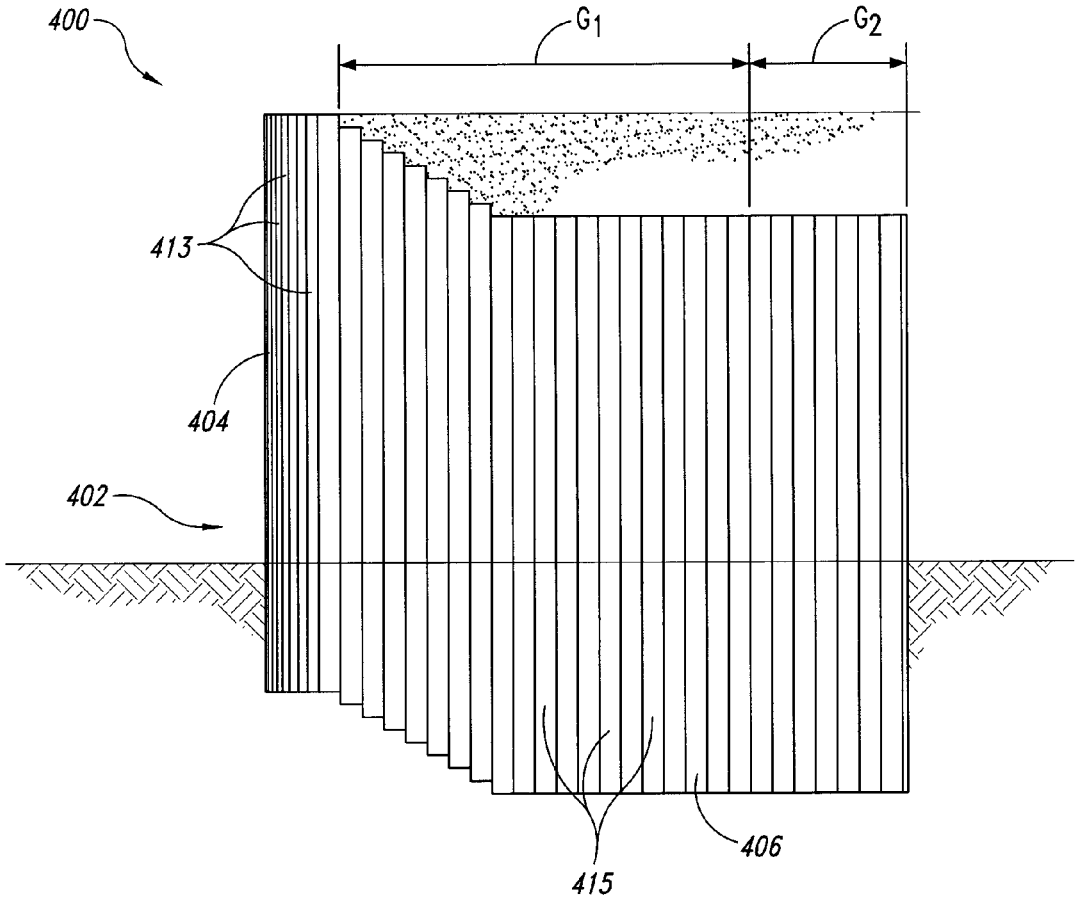

FIG. 4 is a cross-sectional side view of a system 400 configured in accordance with yet another embodiment of the disclosure and particularly suited for expansion of a tail wall at a later date. The system 400 illustrated in FIG. 4 includes several features that are generally similar in structure and function to the corresponding features of the systems described above with reference to FIGS. 1A-3. For example, the system 400 includes a cell structure 402 with a tail wall 406 extending away from a face wall 404. The tail wall 406 includes multiple interconnected tail wall sheet piles 415, and the face wall 404 includes multiple interconnected face wall sheet piles 413. In the illustrated embodiment, however, the tail wall 406 includes a first group $G_1$ and a second group $G_2$ of the tail wall sheet piles 415. The tail wall sheet piles 415 in the first group $G_1$ represent tail wall sheet piles 415 that have been installed in the system. The second group $G_2$ of tail wall sheet piles 415, however, have been added at later time after the initial and completed installation of the first group $G_1$ of the tail wall sheet piles 415.

The system 400 illustrated in FIG. 4 is particularly suited for situations where additional support from the tail wall 406 may be needed after the initial installation of the tail wall 406. For example, in situations with poor fill material surrounding the first group $G_1$ of tail wall sheet piles 415, the second group $G_2$ of tail wall sheet piles 415 can be added to the tail wall 406 to extend the tail wall 406 and provide additional anchor support without removing the entire wall system 400 or otherwise rebuilding the system 400. The second group $G_2$ of tail wall sheet piles 415 can also provide additional pull-out support where the system 400 may be required to support additional loads or loads that are larger than initially anticipated.

Figure 5:
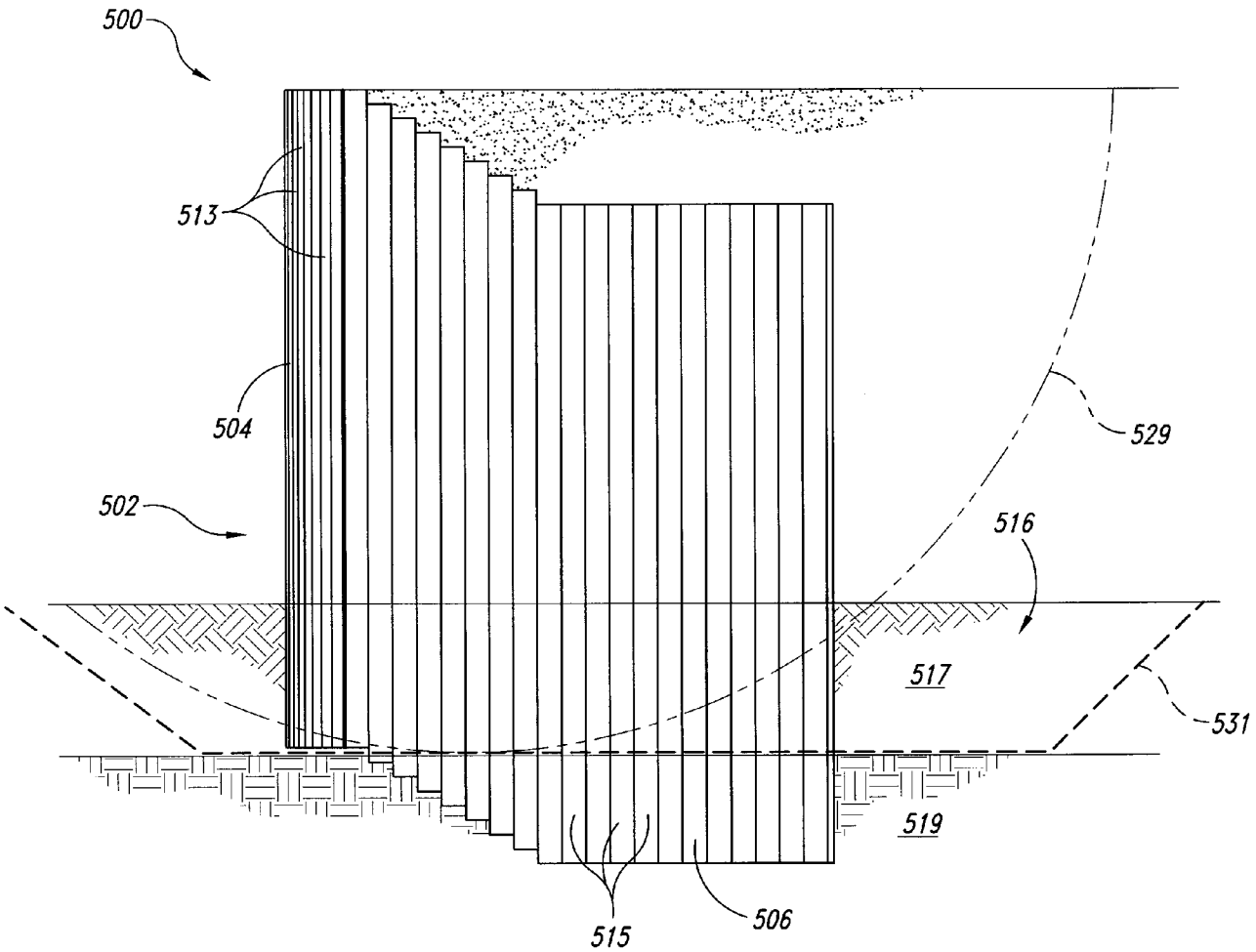

FIG. 5 is a cross-sectional side view of a system 500 configured in accordance with yet another embodiment of the disclosure. The system 500 includes several features that are generally similar in structure and function to the corresponding features of the systems described above with reference to FIGS. 1A-4. For example, the system 500 includes a cell structure 502 with a tail wall 506 extending away from a face wall 504. The tail wall 506 includes multiple interconnected tail wall sheet piles 515, and the face wall 504 includes multiple interconnected face wall sheet piles 513. In the illustrated embodiment, however, the tail wall sheet piles 515 and the face wall sheet piles 513 are at least partially embedded in soil 516 with sections having varying or different densities. More specifically, the soil includes a first section 517 positioned above and adjacent to a second section 519. The first section 517 has a first density, and the second section 519 has a second density greater than the first density. The soil 516 also includes a global stability plane 529, as well as a sliding block failure plane 531. The sliding block failure plane 531 illustrates how the second section 519 can provide the required lateral resistance to prevent failure of the system 500 where soils above this level (e.g., the first section 517) are too soft to provide the required stability. As shown in the illustrated embodiment, the face wall sheet piles 513 extend at least partially through the first section 517. The face wall sheet piles 513 do not, however, extend into the denser section 519 of the soil 516 or beyond the sliding block failure plane 531. The tail wall sheet piles 515 extend through the first section 517 and at least partially into the second section 519 beyond the sliding block failure plane 531. In this manner, the tail wall sheet piles 515 provide sufficient retaining support for the face wall 504 even when the less dense first section 517 would be unsuitable for retaining the face wall 504. In further embodiments, the system 500 can be installed in soil 516 having more than two different densities. Moreover, although the face wall sheet piles 513 do not extend into the second section 519 in the illustrated embodiment, in other embodiments the face wall sheet piles 513 can extend into at least a portion of the second section 519 and beyond the sliding block failure plane 531.

Figure 6:
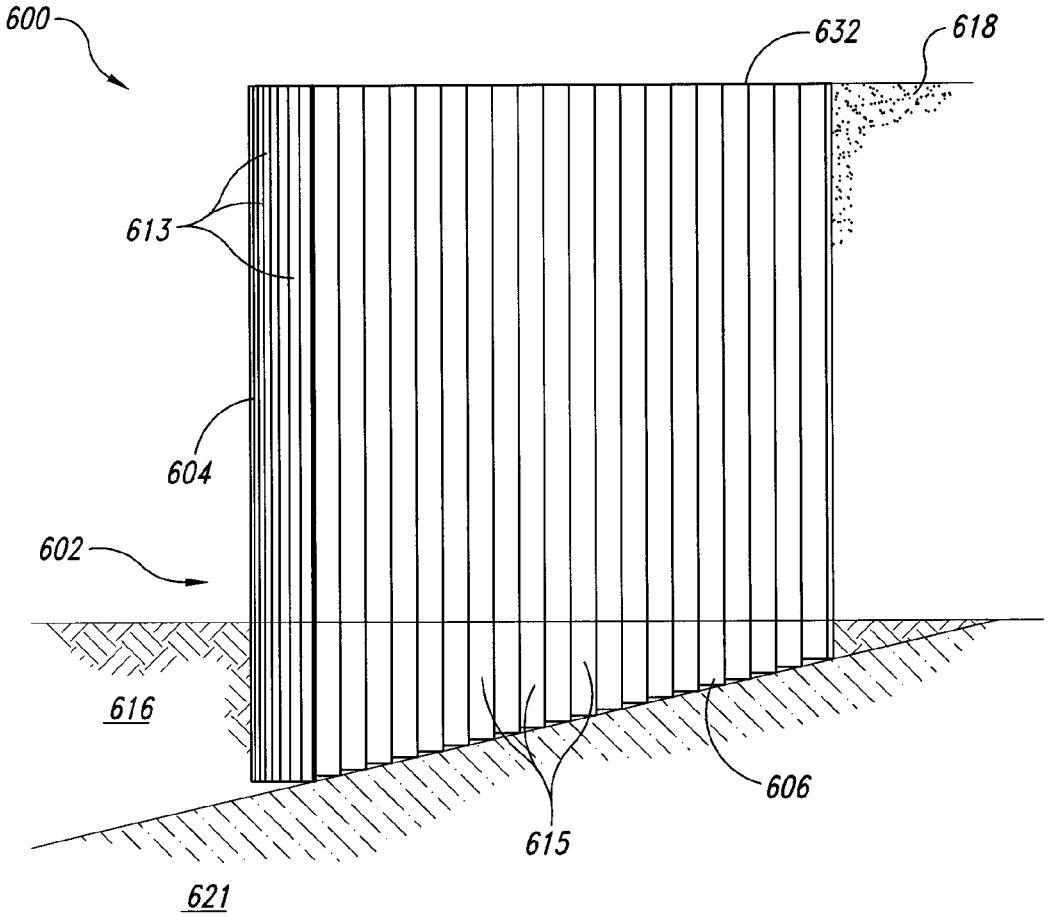

FIG. 6 is a cross-sectional side view of a system 600 configured in accordance with yet another embodiment of the disclosure. The system 600 includes several features that are generally similar in structure and function to the corresponding features of the systems described above with reference to FIGS. 1A-5. For example, the system 600 includes a cell structure 602 with a tail wall 606 extending away from a face wall 604. The tail wall 606 includes multiple interconnected tail wall sheet piles 615, and the face wall 604 includes multiple interconnected face wall sheet piles 613. The system 600 can also include a backfill material 618 at least partially disposed around the tail wall sheet piles 615. In the illustrated embodiment, however the tail wall sheet piles 615 and the face wall sheet piles 613 extend at least partially through a first soil section 616 without extending into a denser second soil section 621. In some embodiments, for example, the second soil section 621 can be a very dense soil, such as rock or bedrock. As such, the tail wall sheet piles 615 can have a staggered pattern aligned with the profile of the second soil section 621 and extending away from the face wall 604.

Although the staggered pattern of the embodiment shown in FIG. 6 shows the lower end portions of the tail wall sheet piles 615 stepped or staggered upwardly with each successive tail wall sheet pile 615 having a progressively shorter length, in other embodiments the tail wall sheet piles 615 can be staggered in the opposite direction (e.g., sloping downwardly with each successive tail wall sheet pile 615 having a progressively longer length). Moreover, although the upper end portions of the tail wall sheet piles 615 form a generally flat or even upper surface 632 aligned with an upper surface of the face wall 604, in other embodiments the upper surface 632 of the tail wall can be higher or lower than the upper surface of the face wall.

From the foregoing, it will be appreciated that specific embodiments have been described herein for purposes of illustration, but that various modifications may be made without deviating from the spirit and scope of the disclosure. Certain aspects and/or features described in the context of particular embodiments may be combined or eliminated in other embodiments. Further, although advantages associated with certain embodiments have been described in the context of those embodiments, other embodiments may also exhibit such advantages, and not all embodiments need necessarily exhibit such advantages to fall within the scope of the disclosure. The following examples provide further embodiments of the disclosure.

We claim:

1. A retaining system at least partially embedded in soil, the retaining system comprising:

a face wall including a plurality of interconnected face wall sheet piles, wherein individual face wall sheet piles have a first length and individual face wall sheet piles extend a first depth into the soil, and wherein the face wall sheet piles form an exterior surface facing an exterior environment;

a first tail wall including a plurality of interconnected first tail wall sheet piles connected with and extending from the face wall away from the exterior environment, wherein individual first tail wall sheet piles have a second length greater than the first length and individual first tail wall sheet piles extend a second depth into the soil that is greater than the first depth; and a second tail wall connected with the first tail wall and including a plurality of interconnected second tail wall sheet piles extending from the first tail wall away from the exterior environment, wherein individual second tail wall sheet piles have a third length approximately equal to or greater than the second length and individual second tail wall sheet piles extend a third depth into the soil, wherein the third depth is equal to or greater than the second depth, wherein the second depth of individual sheet piles of the first tail wall increases uniformly in a staggered fashion from the face wall toward the second tail wall, and wherein the second length of individual sheet piles of the first tail wall increases for the sheet piles that are adjacent to the second tail wall.

2. The system of claim 1 wherein the first tail wall further comprises:

at least one first tail wall sheet piles having a fourth length greater than the second length; and at least one first tail wall sheet piles having a fifth length greater than the fourth length.

3. The system of claim 1 wherein the first tail wall further comprises:

at least one first tail wall sheet piles extending a fourth depth into the soil, wherein the fourth depth is greater than the second depth; and at least one first tail wall sheet piles extending a fifth depth into the soil, wherein the fifth depth is greater than the fourth depth.

4. The system of claim 1 wherein the first tail wall sheet piles in the staggered portion all have the same length.

5. The system of claim 1 wherein the first depth extends at least partially through a first portion of the soil, and wherein the second depth extends through the first portion and at least partially through second portion of the soil, wherein the first portion of the soil has a first density and the second portion of the soil has a second density, the second density being greater than the first density.

6. The system of claim 1 wherein the face wall and the first and second tail walls have a generally U-shaped configuration.

7. The system of claim 1 wherein the exterior environment comprises water.

8. The system of claim 1 wherein the first tail wall includes an end portion opposite the face wall, and wherein the end portion is configured to be attached to additional first tail wall sheet piles at a later time after an initial installation of the first tail wall has been completed.

9. The system of claim 1 wherein the first tail wall includes a first section of consecutive first tail wall sheet piles and a second section of consecutive first tail wall sheet piles, and further wherein:

end portions of the first tail wall sheet piles in the first section are staggered at a varying depth in the soil; and end portions of the first tail wall sheet piles in the second section are positioned at a generally uniform depth in the soil.

10. The system of claim 9 wherein at least one of the tail wall sheet piles in the second section of the first tail wall has a fourth length greater than the second length of the tail wall sheet piles in the first section of the first tail wall.

11. A retaining system at least partially embedded in soil, the retaining system comprising:

a face wall including a plurality of interconnected face wall sheet piles forming an exterior surface, wherein individual face wall sheet piles extend a first depth into the soil; and a tail wall extending from the face wall away from the exterior surface, wherein the tail wall includes:

a first plurality of interconnected tail wall sheet piles, wherein at least one of the tail wall sheet piles of the first plurality extends a second depth into the soil, wherein the second depth is greater than the first depth; and a second plurality of interconnected tail wall sheet piles, wherein at least one of the tail wall sheet piles of the second plurality extends a third depth into the soil, wherein the third depth is greater than the second depth wherein the second depth of individual sheet piles of the first plurality of interconnected tail wall sheet piles increases uniformly in a staggered fashion from the face wall toward the second plurality of interconnected tail wall sheet piles, and wherein the second length of interconnected sheet piles of the first tail wall increases for the sheet piles that are adjacent to the second tail wall.

12. The system of claim 11 wherein the individual face wall sheet piles have a first length, and wherein at least one of the tail wall sheet piles of the first plurality of interconnected tail wall sheet piles has a second length that is greater than the first length.

13. The system of claim 11 wherein:

the soil includes a first section having a first density, and a second section below the first section, the second section having a second density that is greater than the first density; and the individual face wall sheet piles extend only through at least a portion of a first section of the soil, and the tail wall sheet piles of the first plurality of interconnected sheet piles extend through the first section and also through at least a portion of a second section of the soil, wherein the first section of the soil has a first density and the second section of the soil has a second density, and wherein the second density is greater than the first density.

14. A retaining system at least partially embedded in soil, the retaining system comprising:

a face wall including a plurality of interconnected first sheet piles forming an exterior surface, wherein individual first sheet piles have a first length and are at least partially embedded in the soil; and a tail wall extending from the face wall away from the exterior surface, wherein the tail wall includes:

a plurality of interconnected second sheet piles at least partially embedded in the soil, wherein at least one of the second sheet piles has a second length that is greater than the first length, and a plurality of interconnected third sheet piles at least partially embedded in the soil, wherein at least one of the third sheet piles has a third length that is greater than the second length, wherein the interconnected second sheet piles extend to a distance into the soil that increases in a uniformly staggered fashion from the face wall toward the plurality of interconnected third sheet piles, and wherein the second length of individual sheet piles of the second sheet piles increases for the sheet piles that are adjacent to the third sheet piles.

15. The system of claim 14 wherein:

the first sheet piles are embedded a first distance into the soil.

16. The system of claim 14 wherein:

the first sheet piles extend only partially through a first section of the soil; and the second sheet piles extend through the first section and at least partially through a second section of the soil, wherein the first section of the soil has a first density and the second section of the soil has a second density, and wherein the second density is greater than the first density.

17. A method of constructing a retaining wall system, the method comprising:

partially embedding a plurality of interconnected face wall piles in soil at a first depth, wherein the individual face wall piles have a first length;

partially embedding a plurality of interconnected first tail wall piles in the soil at a second depth greater than the first depth, wherein the first tail wall piles extend in a direction away from the face wall piles; and partially embedding a plurality of interconnected second tail wall piles in the soil at a second depth greater than the first depth, wherein the second tail wall piles are adjacent to the first tail wall piles, wherein the second tail wall piles extend in a direction away from the face wall piles, and wherein at least one of the second tail wall piles has a third length greater than the second length, wherein the second depth of individual sheet piles of the first tail wall increases uniformly in a staggered fashion from the face wall toward the second tail wall, and wherein the second length of individual sheet piles of the first tail wall increases for sheet piles that are adjacent to the second tail wall.

18. The method of claim 17 wherein:

partially embedding the face wall piles in the soil comprises partially embedding the face wall piles in a first section of the soil having a first density; and partially embedding the tail wall piles of the first plurality of interconnected sheet piles in the soil comprises embedding the tail wall piles in the first section and partially embedding the tail wall piles in a second section of the soil, the second section having a second density that is greater than the first density.

19. The method of claim 17 wherein after completed installation of the tail wall piles of the first plurality of interconnected sheet piles and after a predetermined amount of time, the method further comprises connecting one or more additional tail wall piles of the second plurality of interconnected sheet piles to an end tail wall pile spaced apart and opposite from the face wall piles.

* * * * *